US005224994A

United States Patent [19]

Daly

[11] Patent Number: 5,224,994

[45] Date of Patent: Jul. 6, 1993

[54] APPARATUS AND METHOD FOR LIQUID TREATMENT OF ARTICLE SURFACES

[75] Inventor: Richard K. Daly, Greer, S.C.

[73] Assignee: Westinghouse Air Brake Company, Wilmerding, Pa.

[21] Appl. No.: 641,437

[22] Filed: Jan. 15, 1991

[51] Int. Cl.[5] ..... B05C 11/00; B05C 13/00

[52] U.S. Cl. ..... 118/53; 118/52; 118/500; 118/416; 118/421; 118/425; 118/429; 118/423; 118/704

[58] Field of Search ..... 118/52, 53, 500, 416, 118/421, 425, 429, 423, 704; 156/497, 567; 134/137, 157

[56] References Cited

U.S. PATENT DOCUMENTS

| | | | |
|---|---|---|---|
| 1,530,185 | 3/1925 | Lorenz | 118/52 |
| 2,824,029 | 2/1958 | Zinty | 118/53 |
| 3,191,574 | 6/1965 | Robertson | 118/320 |
| 4,144,836 | 3/1979 | Bernath | 118/421 |
| 4,696,715 | 9/1987 | Bahr | 156/568 |
| 4,787,956 | 11/1988 | Hoefer et al. | 156/73.5 |

FOREIGN PATENT DOCUMENTS

| | | | |
|---|---|---|---|
| 3270473 | 11/1988 | Japan | 118/416 |
| 486082 | 1/1976 | U.S.S.R. | 118/429 |
| 0596294 | 2/1978 | U.S.S.R. | 118/416 |
| 2902352 | 7/1980 | U.S.S.R. | 118/416 |
| 1171120 | 8/1985 | U.S.S.R. | 118/416 |
| 1297991 | 3/1987 | U.S.S.R. | 118/416 |

*Primary Examiner*—W. Gary Jones
*Assistant Examiner*—Brenda Lamb
*Attorney, Agent, or Firm*—G. J. Falce

[57] ABSTRACT

An apparatus and method is provided for liquid treating, particularly with coating materials such as paint, of an article, especially an article having a plurality of internal passages. The article is simultaneously rotated on an axis of rotation of the article and about a circular travel path into, back and forth in, and out of the liquid bath. The coated article is moved out of the bath, naturally drained under gravity, and then subjected first to low speed, then high speed rotation to clear the article of excess coating liquid and partially to dry the coating.

16 Claims, 7 Drawing Sheets

APPARATUS AND METHOD FOR LIQUID TREATMENT OF ARTICLE SURFACES

BACKGROUND

This application relates to apparatus and methods for treating article surface with liquids. More particularly, the apparatus and methods of the invention is directed to treating or coating with a liquid medium articles having complex surfaces, including, for example, both exterior and interior surfaces of heavily cored castings and/or mechanically formed, e.g. drilled or bored passages and other cavities in such castings and/or in fabricated articles.

The advantages of employing a dipping treatment of articles to be coated or otherwise treated with a liquid medium long has been recognized. Such advantages include, for example, low coating application or other liquid treating cost, amenability to bulk processing, comparative ease of applying heavy (thick) coatings of liquid, speed of film application or other surface treatment, low skill requirements, and ready coverage of "blind" surfaces.

Major problems which have been associated heretofore with dip coating and treatment processes and apparatus include excessive drag off of entrapped liquid media, slowing of otherwise available processing rate due to the time required for gravity drainage, erratic and non-uniform film thickness in coating processes, webbing of the liquid in article cavities, especially threaded holes, and incomplete surface coverage because of entrapped air in the article cavities.

The present invention provides apparatus and methods which achieve all of the advantages of dip coating and other treatment, but which avoid such problems. The invention is especially directed to the coating of articles as above described with films of paint or other coating media. The invention as herein described is applicable, however, to any type of liquid treatment under ambient conditions of temperature and pressure and, as required, can be adapted to other than ambient conditions. A typical example of non-film-coating applications is liquid cleaning of article surfaces.

The invention is most particularly suitable for the painting of exterior and interior surfaces of articles such as cored and drilled metal castings. However, it is to be understood that, in the following description, unless otherwise indicated in a particular context, the terms "painting" and "coating" are to be construed as including application of non-paint liquid films, cleaning and like liquid surface coatings and treatments.

STATEMENT OF THE INVENTION

The above, generally described capabilities of the invention are achieved by rotating an article to be paint-coated in two axes of rotation simultaneously, at variable speeds of rotation, thereby eliminating entrapped gas and centrifugally removing excess coating medium.

The invention will be more fully understood by reference to the following drawings in which:

FIG. 1 is a perspective view of a preferred form of the apparatus of the invention and showing, in simplified form, (1) a coating station comprising a main frame and a movable yoke supporting (a) a vertical, rotatably driven shaft from which depends an article and (b) a horizontal, driven shaft adapted to move the yoke and attached article in a back and forth direction in a coating bath, and (2) in a retracted (rest) position, a movable carriage comprising a tank in which a coating liquid may be contained.

Figure 1:
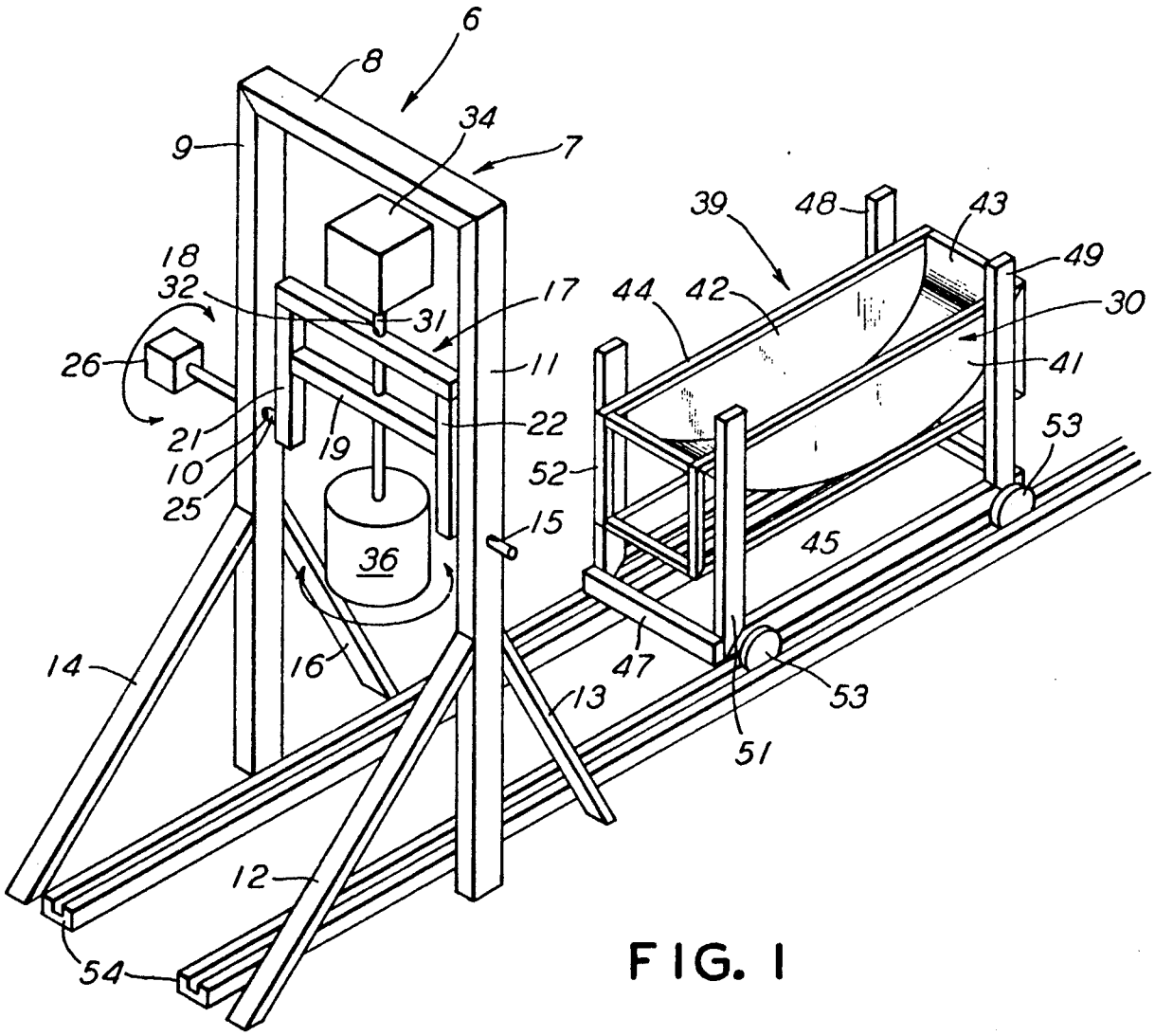
Figure 2:
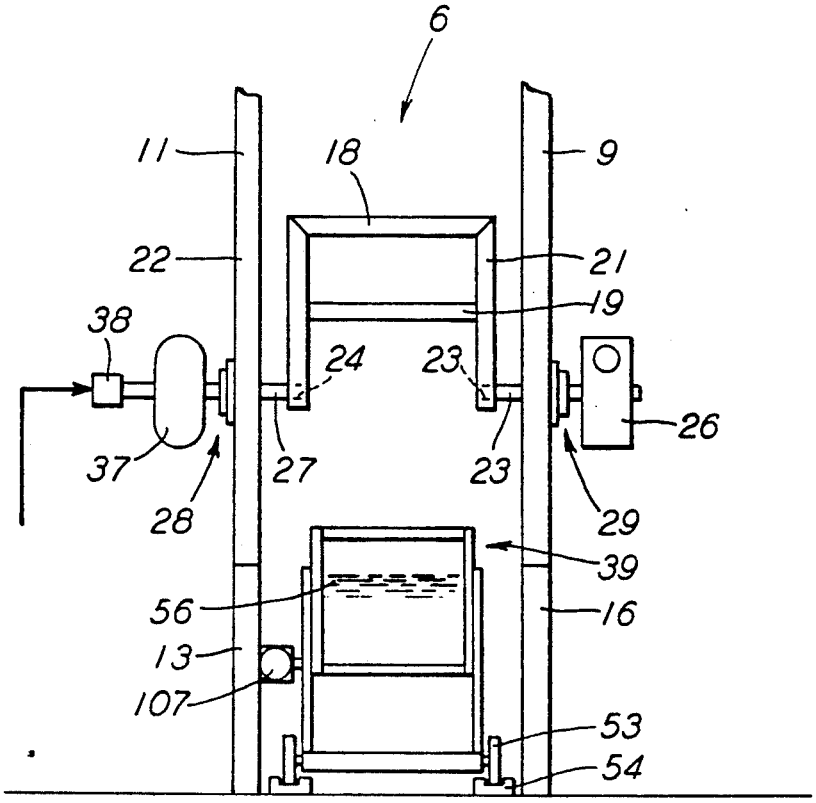
FIG. 2 is an end elevation of the apparatus of FIG. 1, looking from the tank towards the work station, and showing additional elements of the work station apparatus.

Turning to FIGS. 1 and 2, the work station for supporting and moving an article to be coated is denoted generally by the numeral 6. The work station 6 comprises a main frame 7 having a horizontal top beam 8 and two vertical posts 9 and 11, each of which is provided with an aperture for reception of a horizontal shaft, i.e. apertures 10 and 15 respectively. Posts 9 and 11 are connected to and stabilized by post support members 12–16, as shown.

A generally U-shaped yoke 17, has an upper horizontal yoke member 18, a lower horizontal yoke member 19 and two dependent leg members 21 and 22 provided, respectively, with apertures 23 (shown in FIG. 2) and 24 towards the lower extremities of members 21 and 22. The yoke 17 is mounted within the main frame 7 on (1) a first, driven horizontal shaft member 25 extending through aperture 23 in yoke leg 21 and through aperture 10 in post 9, and (2) a second, non-driven horizontal shaft member 27 extending through aperture 24 in yoke leg 22 and through aperture 15 in post 11. Horizontal shaft 25 is rotatably driven through any suitable means, such as a gear box 26 (FIGS. 2 and 11) of usual design and function. For example, the shaft 25 may have a key-way (not shown) geared to a geared hollow sleeve (not shown) in box 26. Such gearing may be driven by any suitable driving means such as a first pneumatic motor (not shown). By such means there is imparted to yoke 17 an arcuate motion about the axis of rotation of shafts 25 and 27. Bearing assemblies 28 and 29 accommodate and support horizontal shafts 25 and 27 respectively.

Figure 13:
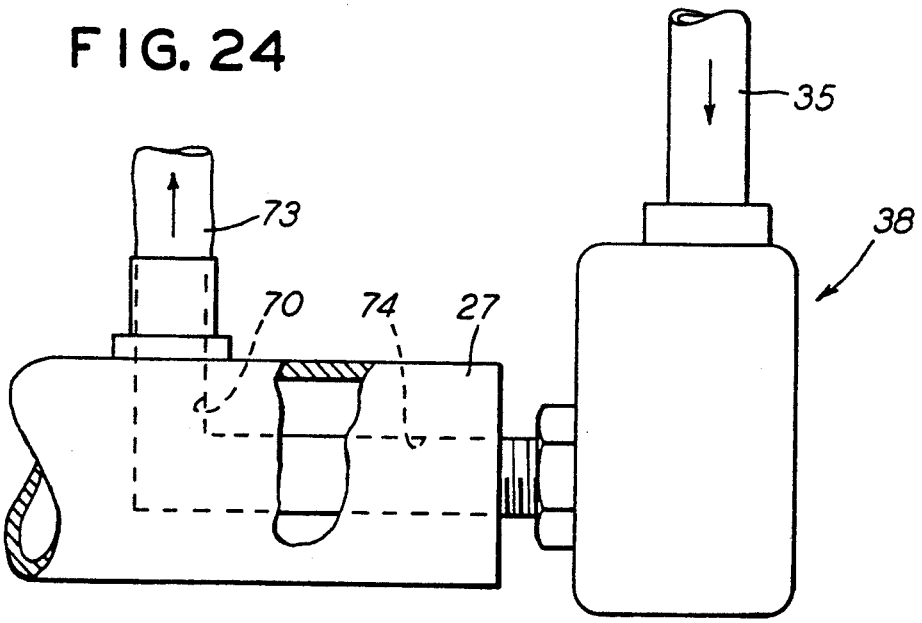
FIG. 13 is a side elevation showing in more detail means for introducing air to an air motor for rotatably driving the vertical shaft from which an article to be coated is suspended.

A vertical shaft 31 is mounted on yoke 17, extending through apertures 31 and 32 in the upper and lower horizontal yoke member, respectively, and is rotatably driven by suitable means, for example a second pneumatic motor 34. A lower extremity of the rotatable vertical shaft 31 carries an article 36 to be coated. Air is provided to motor 34 by suitable means, for example, through a universal swivel coupling 38 (FIG. 2; also see FIG. 13).

A suitable brake means, 37, is provided about a horizontal shaft, for example non-driven shaft 27 as shown in FIG. 2. .

A tank carriage, denoted generally by the numeral 39, comprises a tank, generally denoted by the numeral 30, having tank sides 41 and 42 of semi-circular shape and a bottom 43 of similar shape adapted to hold a coating liquid bath (denoted by the numeral 56 in FIG. 2) and, in an operating position of the apparatus, to accommodate the circular motion path of an article to be coated when the same is rotated through the tank by means of yoke 17 and shaft 31 depending therefrom. The tank carriage also comprises a cradle 45 for supporting the tank 30. Cradle 45 is carried on corner posts 48, 49, 51 and 52 mounted on a carriage base 47 and having slideways (not shown) for slidable movement therein of the cradle 45 during its elevation and lowering. The carriage 39 is provided with wheels 53 riding on tracks 54 for movement of the carriage into and out of an operating position under yoke 17 by suitable driving means, for example a pneumatic cylinder and piston 107 (shown in more detail in FIG. 15).

Figure 3:
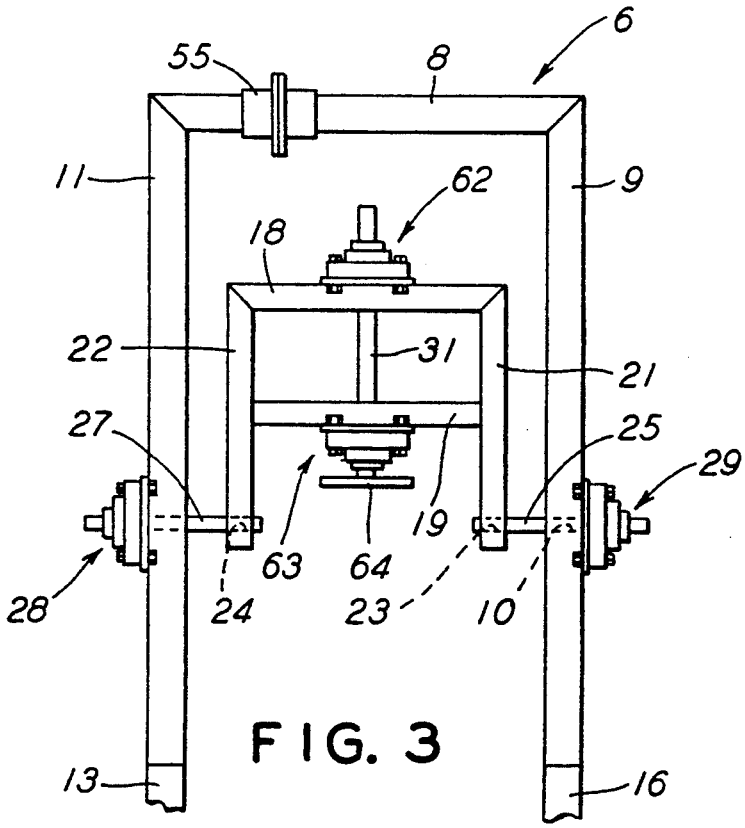
FIG. 3 is a end elevational view of the work station for supporting and moving an article to be coated in accordance with the invention, and showing certain parts of the apparatus in more detail than in FIGS. 1 and 2.
Figure 10:
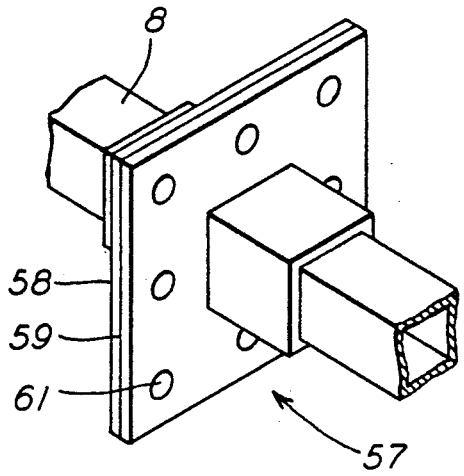
FIG. 10 is a perspective view of one form of splice joint for use in assembly of a part of the framework of the work station apparatus shown in FIGS. 1–4.

The main work station frame 6, which may be constructed, for example, from hollow steel beams, is conveniently assembled with the aid of a splice joint 55 as shown in FIG. 3 (and in more detail in FIG. 10). FIG. 3 also shows the mounting of vertical shaft 31 on yoke 17 by means of a first bushing assembly 62 attached to the upper horizontal yoke member 18 and a second bushing assembly 63 secured to the lower horizontal yoke member 19.

Figure 5:
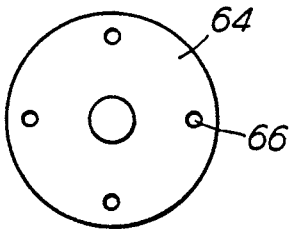
FIG. 5 is an elevational view of a portion of a vertical head assembly for mounting an article to be coated.
Figure 6:
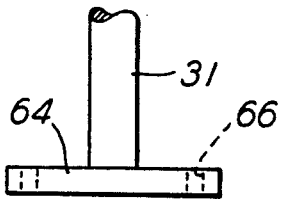
FIG. 6 is an end view of the assembly shown in FIG. 5.

As shown in FIGS. 5 and 6, the lower extremity of vertical shaft 31 carries an adapter plate 64 having apertures 66 for detachable mounting thereon of an article to be coated.

Figure 8:
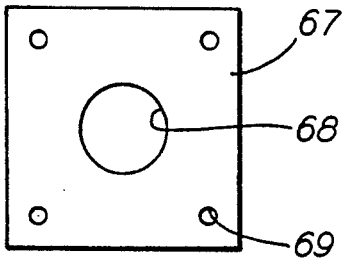
FIG. 8 is a plan view of a horizontal shaft bearing plate.
Figure 7:
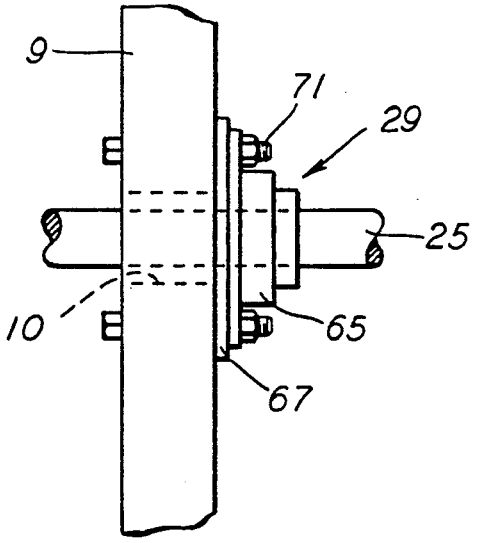
FIG. 7 is a side view of a bearing assembly for the horizontal drive shaft.
Figure 9:
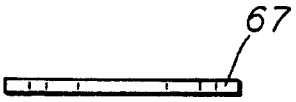
FIG. 9 is a side view of the bearing plate shown in FIG. 8.
Figure 4:
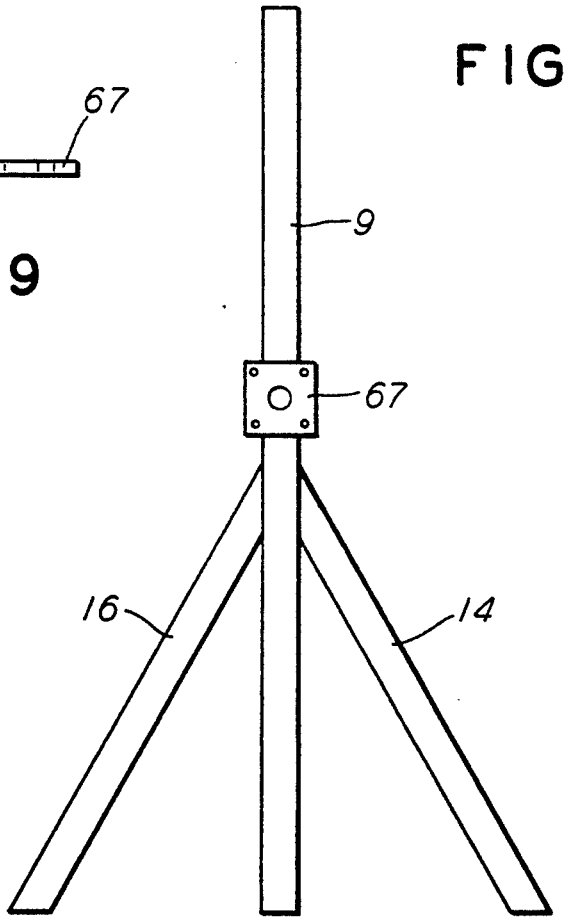
FIG. 4 is a side elevation of the work station shown in FIG. 3.

Bushing assembly 29, carrying the driven horizontal shaft 25, is secured by bolting the assembly to main frame vertical post 9 by means of a horizontal shaft bearing plate 67 having a central aperture 68 for reception of the shaft and bolt holes 69, as illustrated in FIGS. 7, 8 and 9. Similar As shown in more detail in FIG. 11 and 13, air for driving pneumatic motor 34 and, through a connecting shaft 72, thereby rotating vertical shaft 31, is supplied through air line 35 to swivel coupling 38 and into an air passageway 74 extending along the centerline of the non-driven horizontal shaft 27, thence to a cross-drilled connecting passageway 70 extending to the surface of shaft 27, and then through a flexible conduit 73, for example, copper-jacketed hose, to motor 34.

Figure 11:
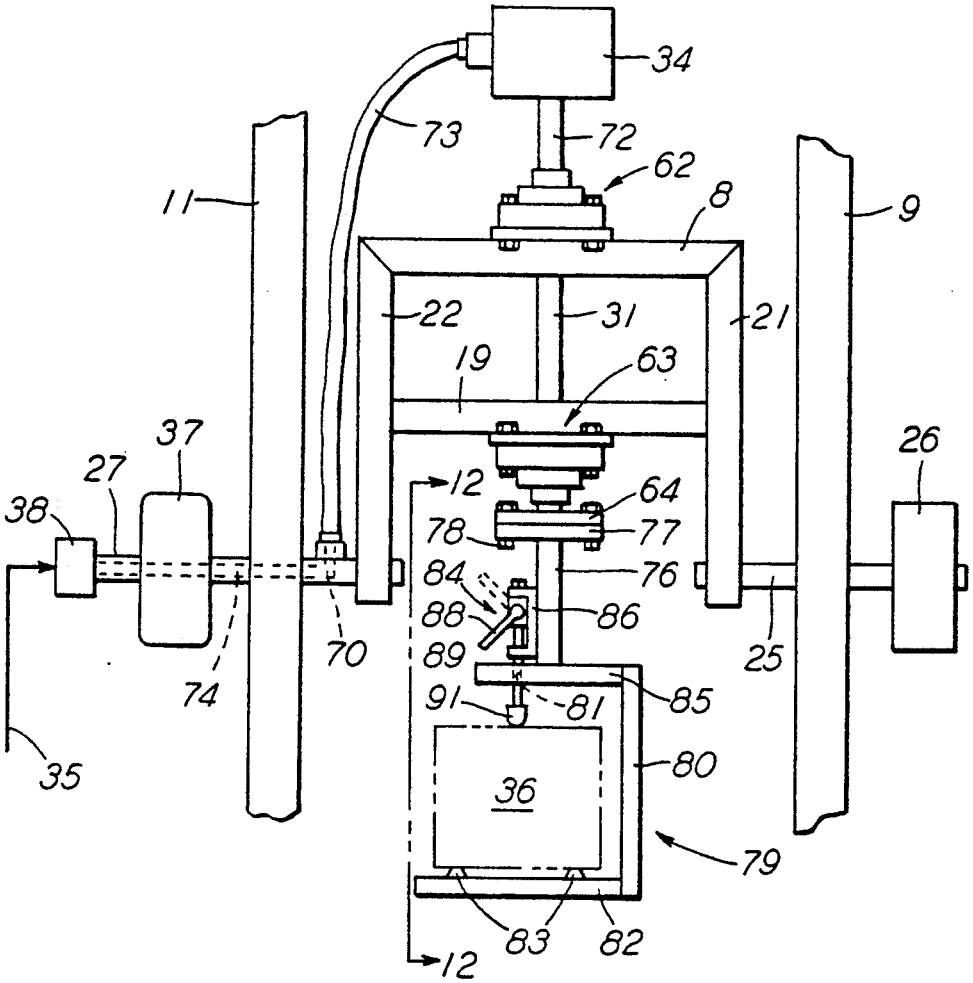
FIG. 11 is a more detailed illustration, in front elevation, of a portion of the work station apparatus for supporting and moving an article to be coated.

As shown in FIG. 11, for operation of the apparatus, adapter plate 64 is connected to a similar connector plate 77, by bolts 74 extending through holes 75 in plate 77. Plate 77 carries a vertical shaft extension member 76 which is affixed to a holder denoted generally by the numeral 79, in which is placed an article 36 to be coated. Holder 79 comprises a pair of vertically extending end members 80, an upper cross member 85, having an aperture 81, and to which member 85 a lower end of vertical shaft extension 76 is secured. Holder 79 further comprises a lower cross member 82 forming a holder base for receiving article 36. Base 82 is provided with set pins 83 for positioning the article for coating.

Figure 12:
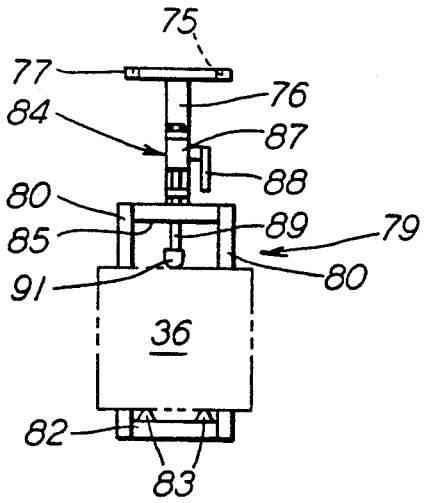
FIG. 12 is a more front elevation, taken along line A—A, in still more detail, of clamping means for detachably securing an article to be coated onto the article support and moving means.

The article to be coated is secured in holder 79 by a clamping device denoted generally by the numeral 84. Clamp 84 is secured to vertical shaft extension 76 by means of bracket 86 carrying an adjustable rachet mechanism 87 (FIG. 12) actuable by means of a handle 88 to lower or raise a plunger 89 having a head 91 through which securing pressure is exerted against the article.

In an operating position of the tank carriage under yoke 17, the tank is raised and lowered by an elevating means such as a scissors jack denoted generally by the numeral 92. The jack is driven by suitable means such as an air-driven piston-cylinder 99 mounted by means of bracket 101 to the carriage frame. The jack comprises a pair of upper arms 93 one end of each arm being connected to a bearing block on the carriage frame through an upper arm pivot 96, the other ends of the upper arms 93 being connected (1) to the driving piston through a first end pivot 98 and (2) to a second end pivot 102 secured to a movable stanchion 103. Ends of a pair of lower arms 94 also are connected to end pivots 98 and 102 and the other lower arm ends are connected to a lower arm pivot 104 secured to the carriage base by means of a fixed anchor block 106.

Figure 15:
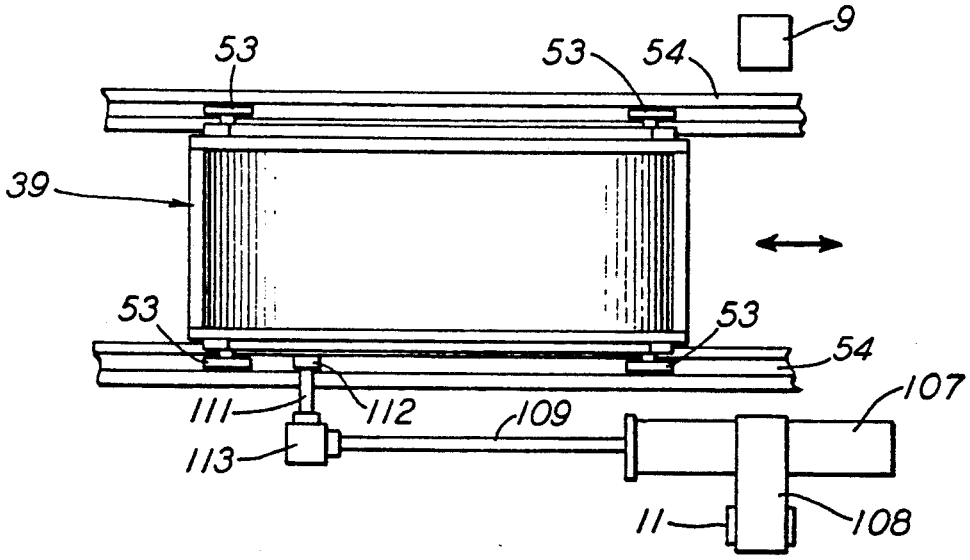
FIG. 15 is a simplified plan view of the dip tank and means for moving it into and out of position for dipping and draining an article to be coated.

As shown in FIG. 15, the tank carriage is moved back and forth along tracks 54 by a pneumatic drive piston 109 connected to cylinder 107 mounted by means of bracket 108 to the main work station frame, as at vertical post 11. Connection of the piston and car is made through a connecting rod 111 and fittings 112 and 113.

In operation of the process and apparatus of the invention, the operating cycle starts with the tank carriage in the rest or home position retracted from the work station 6, as illustrated in FIG. 1. In this position of the carriage, the tank is in a lowered position. The article to be coated is attached to the vertical shaft extension 76 by means of adaptor plates 64 and 78 and the article is clamped into the holding fixture 79. Operation of the apparatus then is commenced. Initiation and cycle sequencing is controlled by a microprocessor programmed to actuate pneumatic solenoid valves, input signals being either switch- or timer-based functions.

Figure 14:
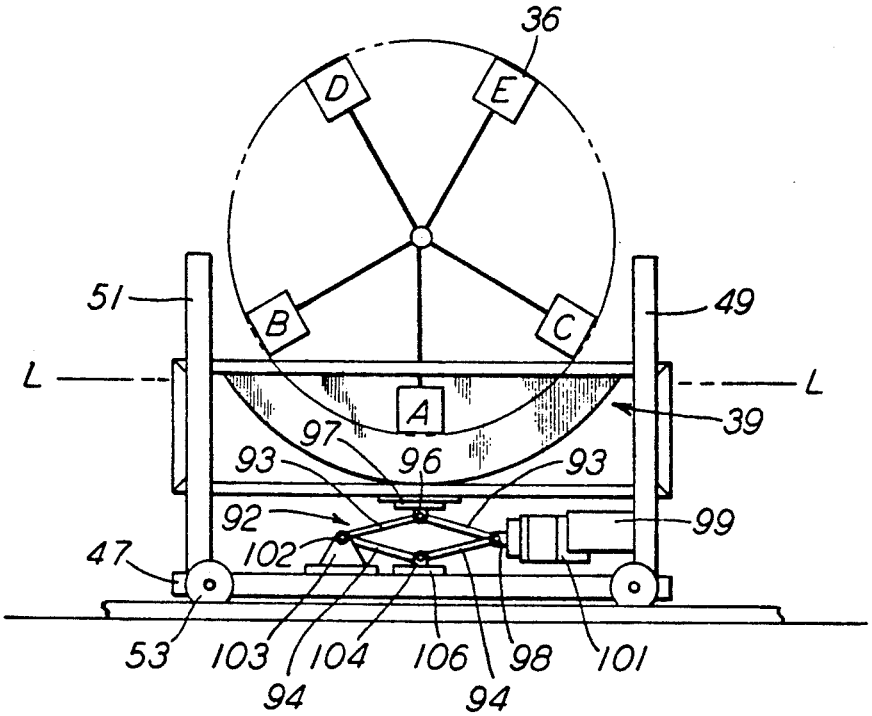
FIG. 14 is a side elevation, partially in section, showing the dip tank, with an article—to be coated with liquid contained in the tank—in various positions during the coating cycle, and also showing a jack means for elevating the tank into and out of various vertical positions relative to the article being processes.

The initial motion starting the coating cycle moves the product to the horizontal position, above the level of the liquid coating bath in the dip tank 30 at its highest position during elevation of the tank. The dip tank 30 is moved forward to a position under the yoke 17 and raised to a full-up position. Rotation of shaft 31, and the attached holding fixture 79 with the article to be coated clamped therein, is started ("Y axis" rotation). Simultaneously, rotation of the yoke 17 and dependent article, defining an "X-axis" travel path of the suspended article, is started and the article is slowly immersed in the coating medium, entering the bath at an angle allowing venting of air entrapped in interior article passages. I have found that entry of the article into the bath at an angle theta (FIG. 14) from over about 130° to under about 140°, particularly 136° serves and is necessary for this purpose. The article is further lowered along the X-axis travel path to a point of complete immersion in the bath in the vertical position of the article. At that position, the top of the article may be, for example, around 2 inches below the surface of the bath, denoted by line L—L in FIG. 14. To ensure that all such article surfaces have needed contact with the coating medium, the article is wagged, i.e. moved through the coating medium by alternately cycling the X-axis rotation in clockwise and counter clockwise directions. After a timed immersion cycle, the length of which depends upon the configuration of the article and the area and type of article surfaces to be coated, as well as the nature of the coating medium, the tank is lowered to a full down position. The tank remains in the forward, work position and the drain portion of the processing cycle is begun. Article draining can be carried out in any article position from approximately the horizontal X-axis position to nearly 180°. Starting with the article in vertical position and slowly spinning, e.g. at about 100 r.p.m. or less about the Y-axis, the article is slowly moved along the X-axis to the desired draining angle from about a horizontal position to nearly vertical above the bath level, allowing the coating medium to drain from the article naturally, under the influence of gravity. Upon completion of such a timed draining cycle, for example about 10 seconds, the article is returned to a vertical position where a high speed Y-axis spin cycle, e.g. at about 250–300 r.p.m., is initiated. Preferably during this high speed spinning cycle, Y-axis rotational power is periodically interrupted, e.g. for about 3 seconds. During this high speed spinning, excess coating medium is centrifugally expelled from the article and the major part of the thus-removed medium drops back into the bath in the tank and is reused. The drain-spin cycle may be, and preferably is, repeated several times until the coating begins to show less dripping and signs of flash drying.

In the final step of the complete cycle the tank carriage is returned to the rest or home position and the coated article is unloaded from the holder 79 and the apparatus is ready for the next full cycle of article coating.

Figure 24:
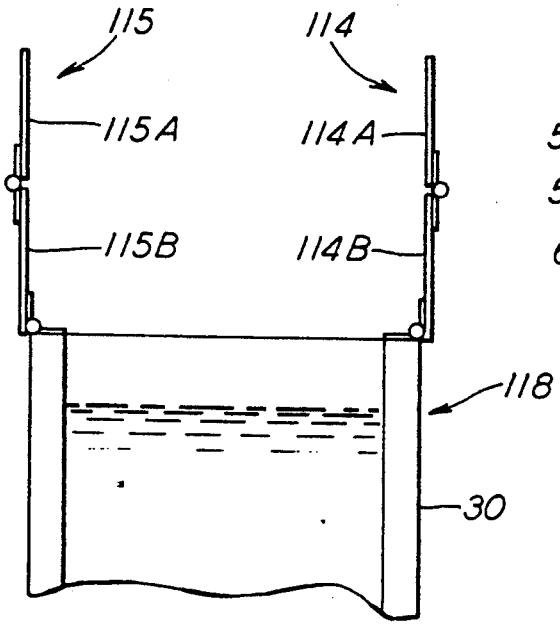
FIG. 24 is an end elevation of part of the dip tank showing the hinged tank panels in more detail, in a full up (spin) position of the tank.

Further economy of paint usage is achieved and paint spattering of surroundings is greatly reduced by provision of fixed end panels 117 extending above the top edges of tank 30 as shown in FIGS. 16, 18, 20 and 22. These effects also are facilitated by provision of a pair of double tank lid panels 114-A and B and 115-A and B as shown in FIGS. 17, 19, 21 and 23. Each pair of panels 114 and 115 is hingedly connected to each other along opposed panel edges and one edge of each of panels 114-A and 115-A is hingedly connected to a corresponding top side edge of the dip tank 30 as more particularly shown in FIG. 24 wherein the bath level is indicated by the numeral 118.

Figure 16:
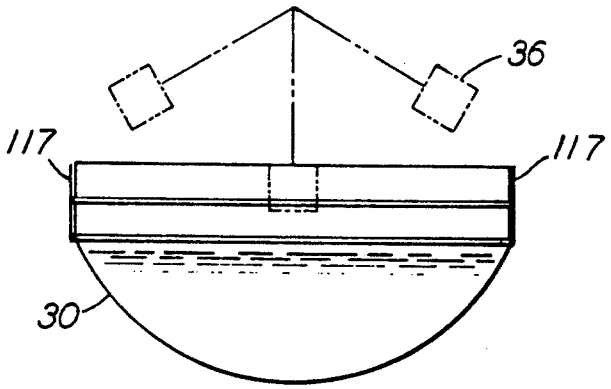
FIGS. 16, 18, 20 and 22 are simplified side elevation views of a dip tank provided with protective fixed panels and hinged panels which are movable to various positions during the coating cycle, and showing the tank in, respectively, a full down (spin) position, a half down (drain) position, a full up (dip) position, and, finally, a full up (storage) position.
Figure 17:
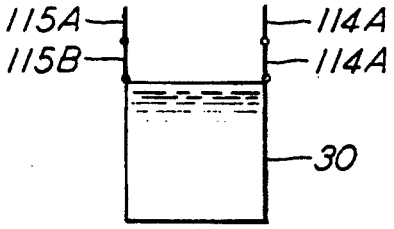
FIGS. 17, 19, 21 and 23 are end elevations showing, respectively, the positions of the hinged tank panels corresponding to the dip tank positions shown in FIGS. 16, 18, 20 and 22.
Figure 18:
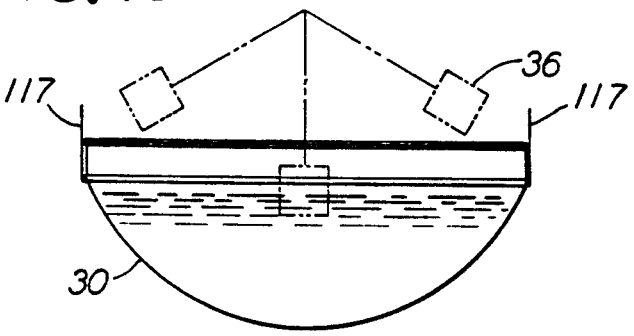
Figure 19:
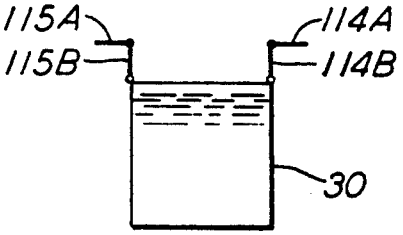
Figure 20:
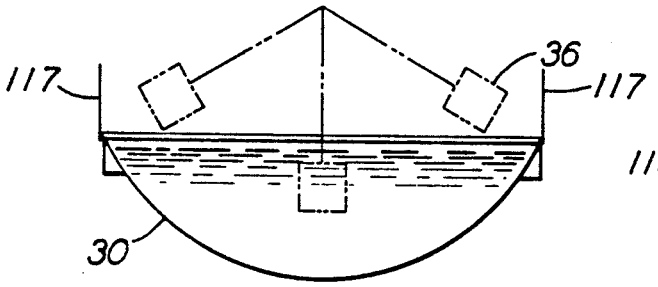
Figure 21:
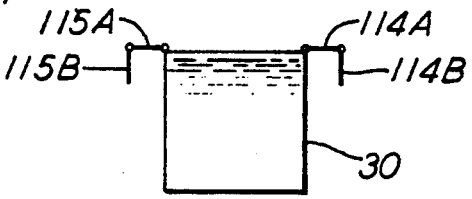
Figure 22:
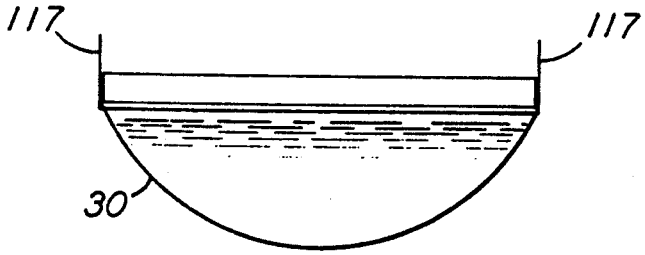
Figure 23:
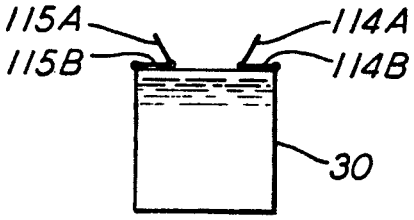

When tank 30 is in a full down, or spin, position as shown in FIG. 16, the hinged panels are fully extended as shown in FIG. 17 in order to catch the comparatively large amount of liquid coating spun off from the high speed rotation of the coated article in vertical position. When the tank is in a partially-up (drain) position as shown in FIG. 18, with the coated article slowly rotating on the Y-axis, the hinged panels may be only partially extended, as shown in FIG. 19, in view of the smaller amount of spin-off liquid. With the tank in a full up (dip) position as shown in FIG. 20, with the article being rotated slowly on the Y-axis and wagged through the bath on the X-axis, the hinged panels 114 and 115 may be fully retracted as shown in FIG. 21. Finally, when the tank is in a full down (storage) position as shown in FIG. 22, the lid panels 114 and 115 may be folded over the top of the tank 116 as shown in FIG. 23, leaving only a narrow open slot between the juxtaposed panels 114-B and 115-B. This configuration of the hinged lid panels aids in preventing evaporation of coating solvents and further increases the economy of the apparatus and methods of the invention.

Because in case of many types of articles to be coated, all ports in the article are not directed radially outwardly of the article exterior, it is effective to rotate such articles slowly on the Y-axis while holding the article in a position on the Y-axis travel path from just above horizontal to nearly vertical above the bath surface, thus allowing the coating liquid to flow evenly inside the article passages and excess liquid to drain from interior passages in the article, as well as from the article's exterior surface.

In addition to the previously described advantages provided by the invention, a further and very important benefit in both operating time and time for full processing of coated articles is the fact that the high speed spinning of the article during draining increases air flow over the coated article so that volatile components of the coated film evaporate quickly. Normally, when coating in accordance with the invention with paint and similar compositions having a volatile solvent, the coated article (with sometime exception of some interior passages) is at least 50 to 60% dry when removed from the apparatus after treatment as described. On average, with use of the invention, most coated articles are nearly dry within 8 to 10 minutes after removal from the coating apparatus, can be easily handled within one hour, and essentially fully dry within 8 hours under usual ambient conditions without special drying efforts.

I claim:

1. An apparatus for treating an article with a treating liquid, said apparatus comprising:

(a) a means for detachably suspending and moving the article in a variable position within a travel path extending up to 360° in either direction from a vertical reference position of the article suspended from said means and for simultaneously rotating the suspended article at variable speeds of rotation about an axis of rotation of the article;

(b) a tank means for containing a treating liquid bath therein;

(c) a first means connected to said tank means for each of elevating and maintaining said tank means into a position such that the article can be moved into and maintained within, respectively, a treating liquid bath zone intersecting a portion of the article travel path when said tank means disposed below and in an elevated position with respect to said means for detachably suspending the article and when said means for detachably suspending the article is in a substantially vertical position and for enabling holding the treated article in a position along the travel path outside the bath zone and for lowering said tank means to permit draining of excess treating liquid from the treated article when said tank mechanism is in a lowered condition; and (d) a carriage means having said tank means positioned thereon and movable horizontally into a work position in which said tank means is below said means for detachably suspending the article and into a rest position remote from said means for detachably suspending the article.

2. Apparatus according to claim 1, wherein the apparatus further includes means continuously to vary the height of the bath reservoir and its vertical spatial relationship with the article to be treated.

3. Apparatus according to claim 2, wherein the apparatus further includes means releasably to secure the article to be treated in a fixed position during treatment.

4. Apparatus according to claim 3, wherein the article suspension and rotating means comprises an upright main frame having a pair of vertically extending posts and a horizontally extending top beam secured at each end to a top end of vertically extending post, and wherein each of the vertical posts is provided with an aperture for reception of a rotatable horizontal shaft.

5. Apparatus according to claim 4, wherein a first, driven horizontal shaft extends through the aperture in one of the vertical posts and is rotatably secured at one end thereof to such post, and wherein a second, non-driven horizontal shaft extends through the aperture in the other vertical post and is rotatably secured at one end thereof to such post, and wherein the other ends of each of the horizontally extending shafts is secured to a vertically depending leg of a generally U-shaped yoke having at least an upper and a lower horizontal cross member extending between and secured at opposite ends thereof to the depending legs of the yoke, such cross members having mutually vertically aligned apertures, and a vertical shaft for suspending the article to be treated extending through such apertures and rotatably mounted on the yoke cross members.

6. Apparatus according to claim 5, wherein means to drive the vertical shaft is mounted on the upper yoke cross member.

7. Apparatus according to claim 6, wherein the vertical shaft drive means is a pneumatic motor, and the apparatus further includes means to supply air to such motor through a passageway in the non-driven horizontal shaft and connectable to a swivel coupling which in turn is connectable to a compressed air source.

8. Apparatus according to claim 7, further including a gear means detachably engageable with a gearing element on the vertical shaft.

9. Apparatus according to claim 8, further including a pneumatic motor connectable to gear means to drive the driven horizontal shaft.

10. Apparatus according to claim 9, further including brake means connectable to one of the rotatable horizontal shafts to aid in control of rotation of the shaft and the yoke secured thereto.

11. Apparatus according to claim 1, wherein the bath reservoir has sides and a bottom of generally semicircular shape of radius just sufficiently less than that of a circular arc described by the travel path of the article to be treated to permit movement of the article along the travel path when the bath reservoir is in the work position and at its greatest height.

12. Apparatus according to claim 11, additionally including means for substantially containing excess liquid thrown off the article after coating and during spinning of the article on its rotational axis, and for directing such excess liquid into the bath reservoir.

13. Apparatus according to claim 12, wherein the excess liquid containing and directing means comprises at least two panels movable into and out of a substantially vertical position above the sides of the bath reservoir.

14. Apparatus according to claim 13, wherein the panels are movable into positions of different heights above the top of the bath reservoir and into a storage position substantially closing the top of the bath reservoir.

15. Apparatus according to claim 14, wherein the movable panels are side panels hingedly attached to the top side edges of the bath reservoir, and the apparatus additionally comprises a pair of fixed end panels extending above the ends of the bath reservoir.

16. Apparatus according to claim 15, additionally including separate means to control each of (a) the movements of the carriage into and out of the work position, (b) the raising and lowering of the bath reservoir under the article suspension means, (c) the rotation of the article suspension means and its movement along the article travel path, and (d) the movement of the movable panels, in accordance with a programmed article treating cycle.

* * * * *